US010507401B1

(12) United States Patent
Tong et al.

(10) Patent No.: US 10,507,401 B1
(45) Date of Patent: Dec. 17, 2019

(54) BUILDING PIECE COMPRISING TWO CONTAINERS AND A FLEXIBLE BELT THEREBETWEEN

(71) Applicants: Kun Yuan Tong, Suwanee, GA (US); John Tong, Southlake, TX (US)

(72) Inventors: Kun Yuan Tong, Suwanee, GA (US); John Tong, Southlake, TX (US)

( * ) Notice: Subject to any disclaimer, the term of this patent is extended or adjusted under 35 U.S.C. 154(b) by 0 days.

(21) Appl. No.: 16/554,591

(22) Filed: Aug. 28, 2019

(51) Int. Cl.
*A63H 3/16* (2006.01)
*A63H 33/10* (2006.01)
*A47G 33/08* (2006.01)

(52) U.S. Cl.
CPC ..... *A63H 33/102* (2013.01); *A63H 3/16* (2013.01)

(58) Field of Classification Search
CPC ..... A63H 33/00; A63H 33/04; A63H 33/044; A63H 33/16; A63H 3/16; A47G 33/08; A47G 7/085; A63F 9/088; A63F 2007/3655
USPC ..... 446/85, 108–109, 111, 75–76, 80, 487, 446/488; 428/9, 12, 126
See application file for complete search history.

(56) References Cited

U.S. PATENT DOCUMENTS 2,787,073 A * 4/1957 Woolven ..... A47G 33/08 428/9
3,060,609 A * 10/1962 Woolven ..... A47G 33/08 428/12
5,422,158 A * 6/1995 Cheng ..... A63F 9/088 428/126

* cited by examiner

*Primary Examiner* — Kien T Nguyen
(74) *Attorney, Agent, or Firm* — Guosheng Wang; United States Research and Patent Firm

(57) ABSTRACT

The present invention provides a building piece toy including a first container comprising a first cavity with a first opening, a second container comprising a second cavity with a second opening, and a flexible belt connecting said two containers. The container is tapered monotonously in all dimensions from the opening to the rest of the container's body. Many of the building pieces are interlockable to each other, so a player can create toys with a shape of human, animal, or plant such as lobster, butterfly, peacock and chicken.

17 Claims, 6 Drawing Sheets

BUILDING PIECE COMPRISING TWO CONTAINERS AND A FLEXIBLE BELT THEREBETWEEN

FIELD OF THE INVENTION

The present invention generally relates to a building piece used for a construction set that allows for the construction of a variety of different models. The building piece includes two containers and a flexible belt connecting the two containers. Any of the two containers in one such building piece can be reversibly interlocked to such a container of another building piece.

BACKGROUND OF THE INVENTION

Playing with toys can be an enjoyable means of training young children for life in society. It provides entertainment while fulfilling an educational role. Playing with toys is considered to be important when it comes to growing up and learning about the world around us. Younger children use toys to discover their identity, help their bodies grow strong, learn cause and effect, explore relationships, and practice skills they will need as adults. Toys enhance children's cognitive behavior and stimulate their creativity.

Among existing assembly toys, the toy block structure is formed by fitting toy blocks having concave and convex portions. For example, Lego allows a desired shape to be formed by assembling hexagonal blocks. Each of Lego blocks has a protrusion and a recess such that the Lego blocks are coupled to each other, and the Lego blocks may be assembled in various shapes by using the protrusions and recesses. Lego extends (or is built longitudinally) along direction of the protrusions and the recesses. Accordingly, it is relatively difficult to assemble the shape that extends or is built laterally and there are many restrictions in manufacturing a desired shape by the user.

Therefore, there exists a need to overcome the aforementioned problems. Advantageously, the present invention provides a solution.

SUMMARY OF THE INVENTION

One aspect of the present invention provides a building piece including a first container comprising a first cavity with a first opening, a second container comprising a second cavity with a second opening, and a flexible belt connecting said two containers. The first container is tapered monotonously in all dimensions from the first opening to the rest of the first container's body, so that another container that is identical to the first container can insert its tapered body into the first cavity through the first opening. Similarly, the second container is also tapered monotonously in all dimensions from the second opening to the rest of the second container's body, so that another container that is identical to the second container can insert its tapered body into the second cavity through the second opening.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form, omitted, or merely suggested, in order to avoid unnecessarily obscuring the present invention.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

Figure 1:
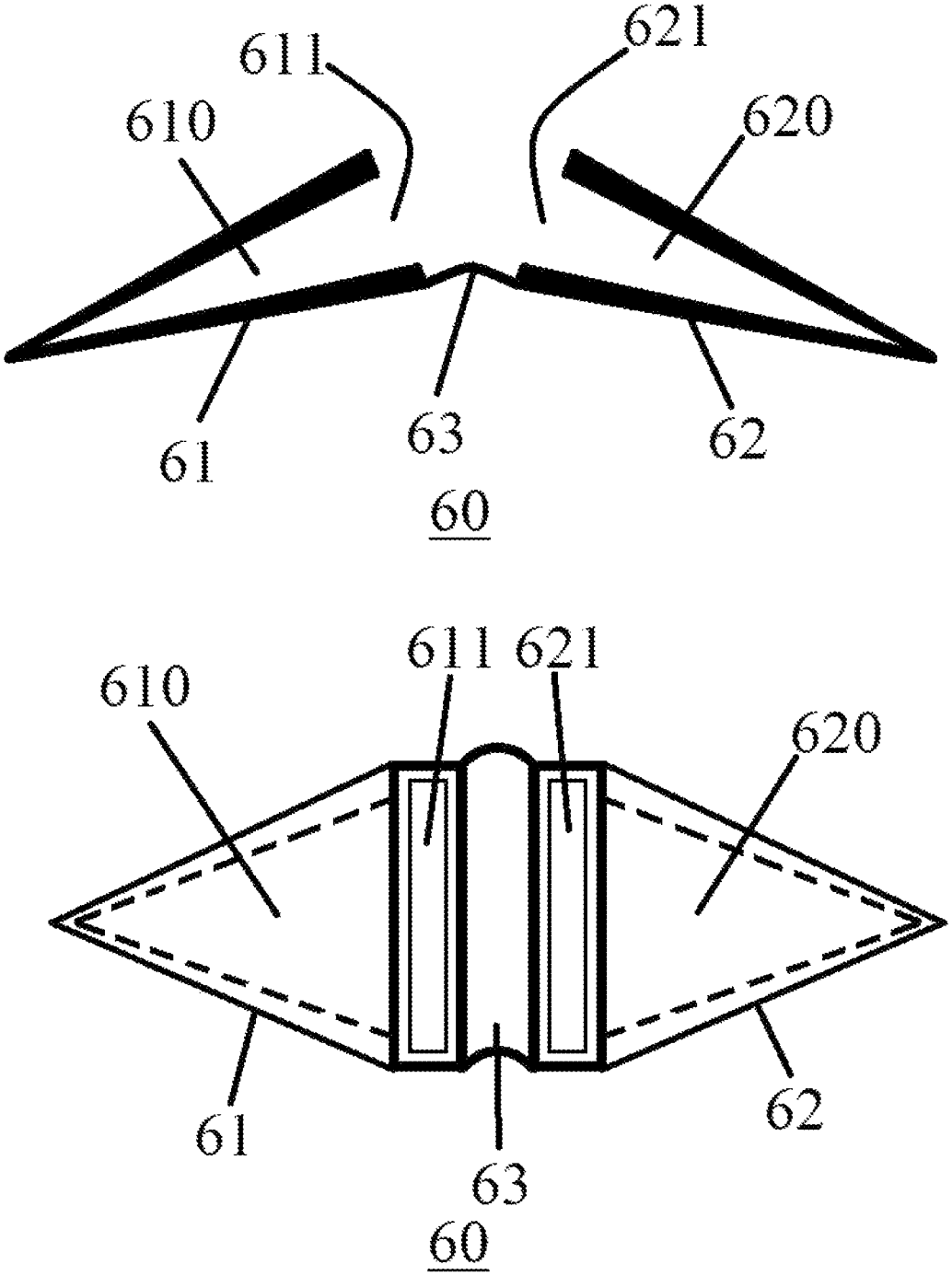
FIG. 1 schematically illustrates a building piece comprising two interlockable containers in accordance with an exemplary embodiment of the present invention.

With reference to FIG. 1, a building piece 60 includes a first container 61 comprising a first cavity 610 with a first opening 611, a second container 62 comprising a second cavity 620 with a second opening 621, and a flexible belt 63 connecting said two containers 61 and 62. The first container 61 and the second container 62 may be different, or they may be identical to each other.

Figure 2:
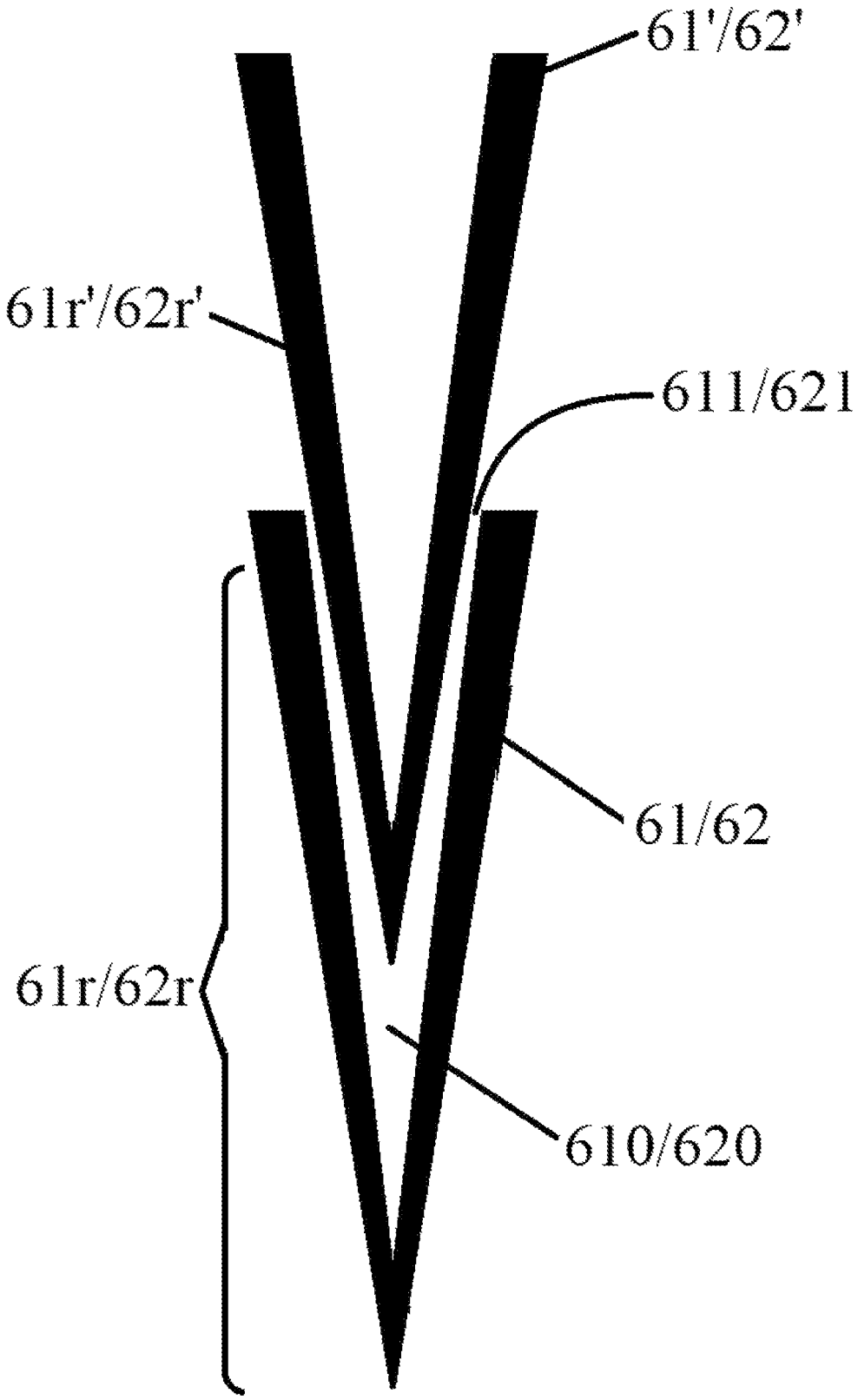
FIG. 2 shows the connection of two interlockable containers in accordance with an exemplary embodiment of the present invention.

As shown in FIGS. 1 and 2, the first container 61 is tapered monotonously in all dimensions (e.g. thickness, height and width) from the first opening 610 to the rest of the first container 61's body (61*r*), so that another container 61' that is identical to the first container 61 can insert its tapered body 61*r'* into the first cavity 610 through the first opening 611. Similarly, the second container 62 is also tapered monotonously in all dimensions (e.g. thickness, height and width) from the second opening 620 to the rest 61*r* of the second container 62's body, so that another container 62' that is identical to the second container 62 can insert its tapered body 62*r*' into the second cavity 620 through the second opening 621.

Figure 3:
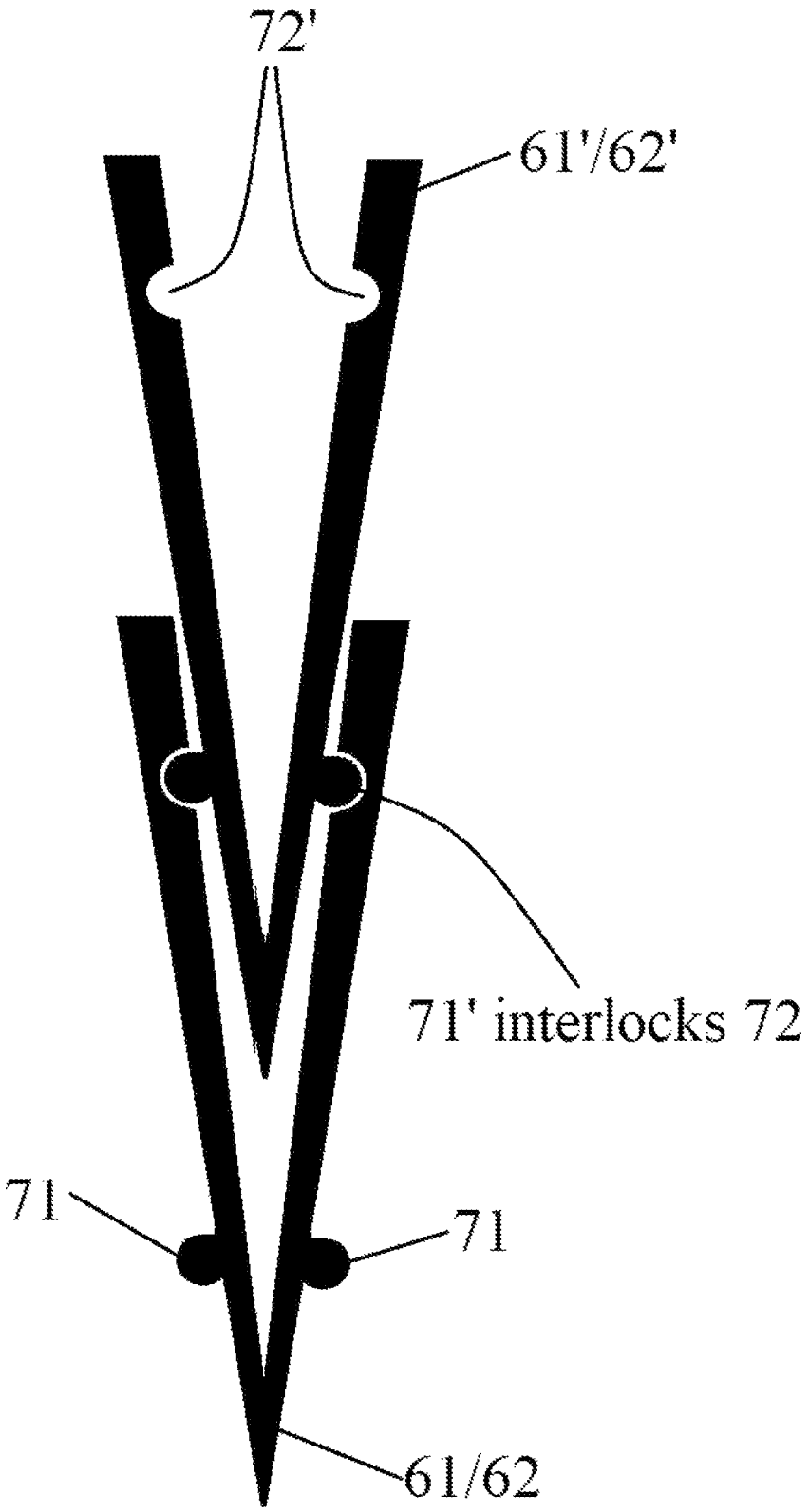
FIG. 3 illustrates another way of connecting two interlockable containers in accordance with an exemplary embodiment of the present invention.

The term "landscape" is a topographical profile of the land. Topography is the study of the shape and features of land surfaces. The topography of an area could refer to the surface shapes and features. Two landscapes may be structurally mutually complementary to each other, and are therefore capable of interlocking to each other, or fit into each other. In a preferred embodiment as shown in FIG. 3, the first container 61 may further comprise one, two or more landscapes (or topographical profiles), for example balls 71 and receivers 72 such as ball cavities or holes, so that, after another container 61' that is identical to the first container 61 inserts its tapered body 61*r*' into the first cavity 610 through the first opening 611, a landscape of the first container 61 (e.g. a receiver 72) can be reversibly interlocked to a landscape (e.g. a ball 71') of said another container 61' that is identical to the first container 61. In another embodiment (not shown), the first container 61 may be inserted into another container 61', and a receiver 72' can be reversibly interlocked to a ball 71. Similarly, the second container 62 may also further comprise one, two or more landscapes (or topographical profiles), for example balls 71 and receivers 72 such as ball cavities or holes, so that, after another container 62' that is identical to the second container 62 inserts its tapered body 62*r*' into the second cavity through the second opening, a landscape of the second container 62 can be reversibly interlocked to a landscape of said another container 62' that is identical to the second container 62. In these embodiments, the first container 61 and the second container 62 may be different, or they may be identical to each other.

Referring back to FIGS. 1 and 2, the first opening 610 and the second opening 620 are proximal to the flexible belt 63, and the rest of the first container 61*r* and the rest of the second container 62*r* are tapered away distally from the flexible belt 63. In some embodiments, the first container 61 and the second container 62 are triangle-shaped. A side of the triangle shape is proximal to the flexible belt 63, and the rest of the first/second container 61*r*/62*r* is tapered away distally from the flexible belt 63 to a vertex of the triangle shape. In other embodiments, the first container 61 and the second container 62 may be trapezoid-shaped.

Figure 4:
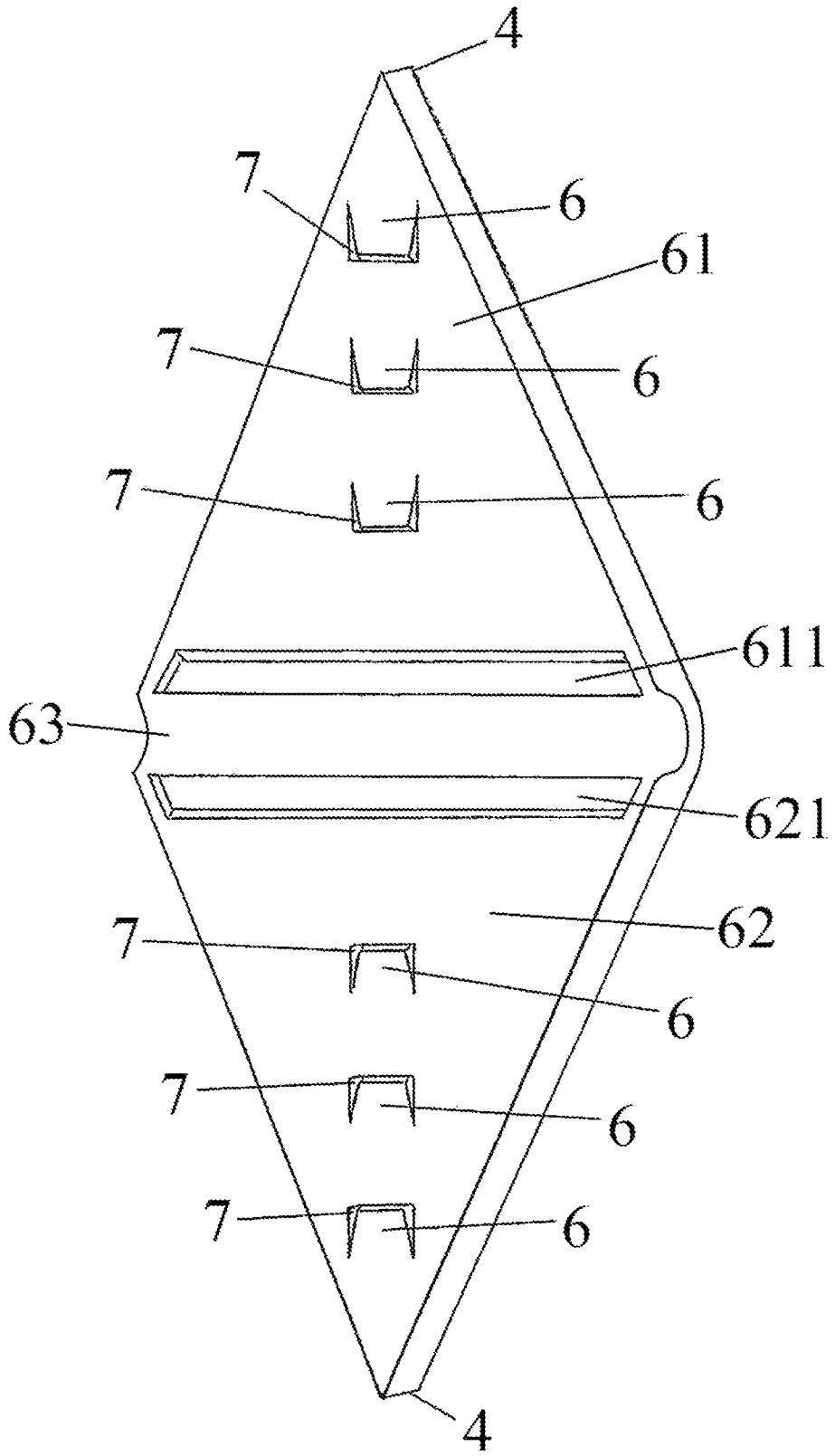
FIG. 4 illustrates a building piece comprising two interlockable containers in an extended configuration in accordance with an exemplary embodiment of the present invention.
Figure 5:
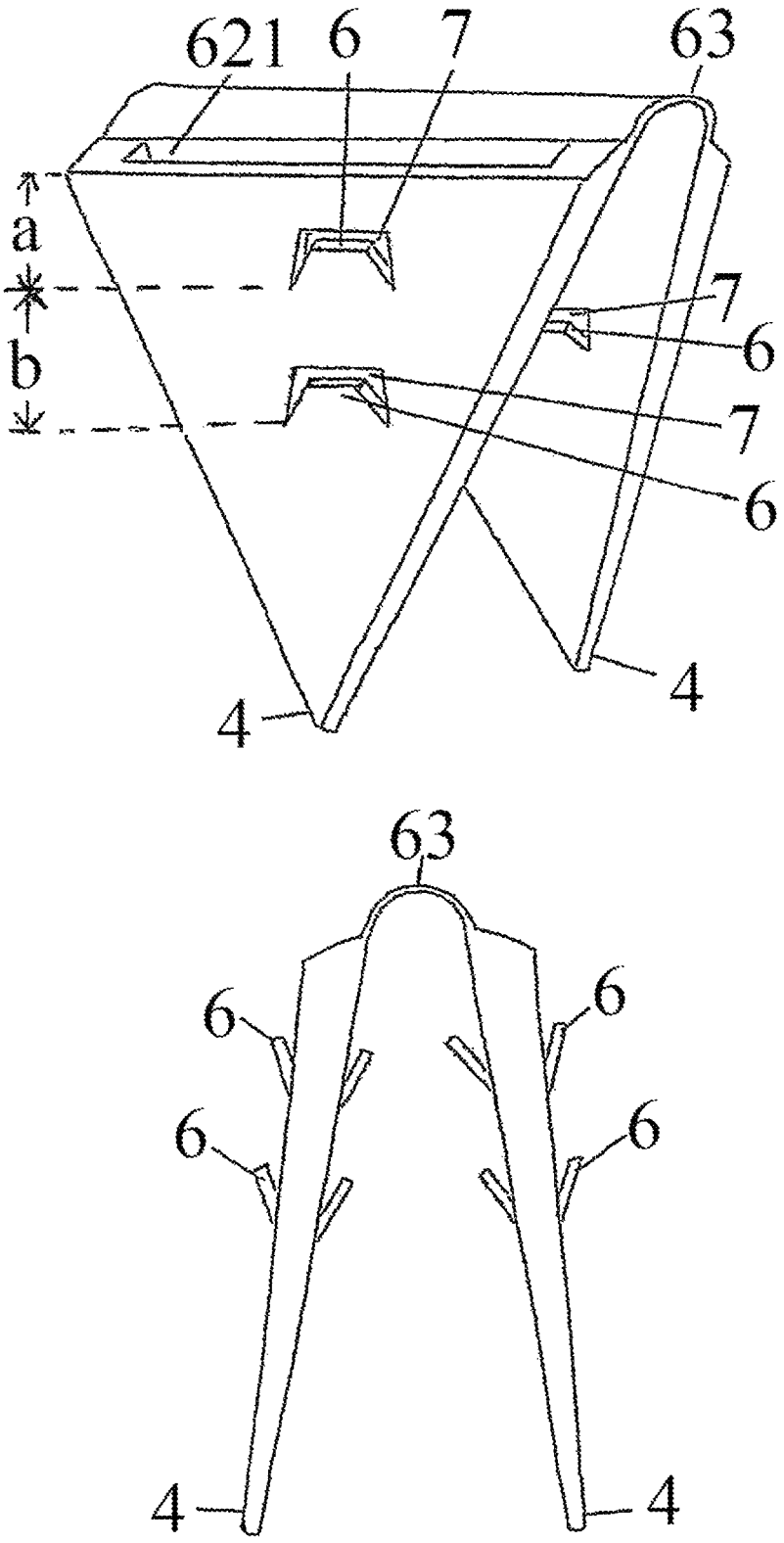
FIG. 5 schematically illustrates a building piece comprising two interlockable containers in a folded configuration in accordance with an exemplary embodiment of the present invention.
Figure 6:
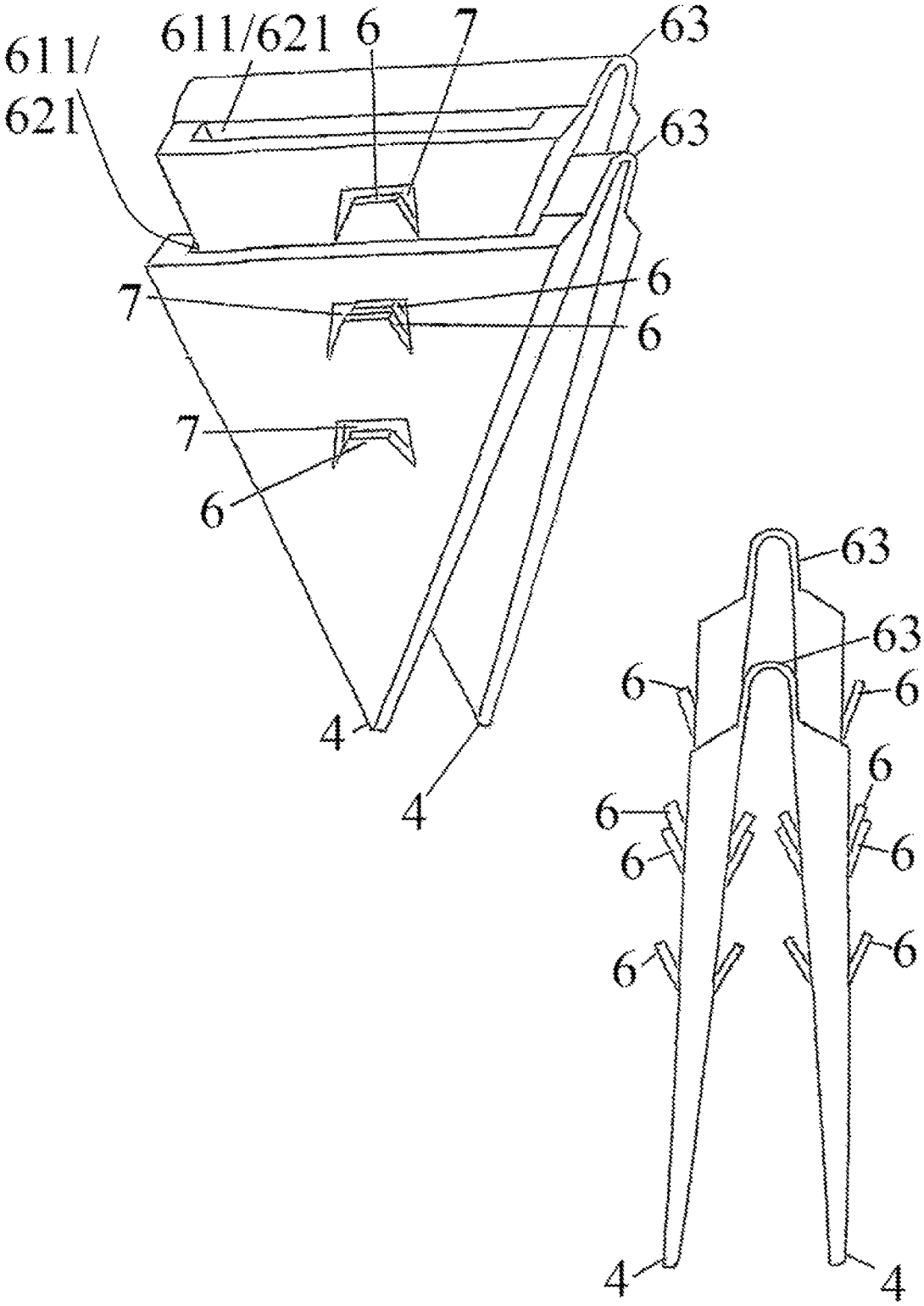
FIG. 6 schematically illustrates two building pieces that are interlocked to each other in accordance with an exemplary embodiment of the present invention.

In various exemplary embodiments, at least one of the aforementioned landscapes includes a window through a wall of cavity 610/620, and a protrusion sticking out from the window like a tongue sticks out from a mouth. The building piece may be constructed like a butterfly-shaped with double plastic pouches equipped with interlocking device. Preferably, the protrusion is a trapezoid fan or a triangular fan, and the window is trapezoid window. With reference to FIGS. 4, 5 and 6, the present invention provides a building piece including butterfly-shaped double plastic pouches equipped with interlocking device. The butterfly-shaped double plastic pouch equipped with interlocking device comprises two linked triangular plastic pouches 61/62 (an embodiment of the aforementioned container 61/62) which have multiple built-in locking devices at both sides of pouch to lock them together to build a variety of things. Referring to FIGS. 4-6, the first pouch 61 and the second pouch 62 are triangle-shaped. A side of the pouch's triangle shape is proximal to the flexible belt 63, and the rest of the first/second pouch is tapered away distally from the flexible belt 63 to a vertex 4 of the triangle shape (or a foot 4). The two triangular plastic pouches (61, 62) may be linked together at one rim of their rectangular openings (611, 621). In other embodiments, the first pouch 61 and the second pouch 62 may be trapezoid-shaped.

FIG. 4 shows the piece in an open flat configuration or an extended configuration, and FIGS. 5 and 6 show the piece in a closed or folded configuration. A window 7 is built through a wall of cavity 610/620, and a protrusion 6 is sticking out from the window 7 like a tongue sticks out from a mouth. Protrusion 6 may be trapezoid fan 6 of interlocking device. The trapezoid fan 6 is bent slightly outward with a bending degree of 10°-45°. Trapezoid fans 6 (if more than 2) are spaced at equal distance (in addition, a=b in FIG. 5), and aligned at a line vertical to the opening 611/621 of each pouch 61/62. The trapezoid fan 6 can be of other kind of shape, such as triangular fan or rectangular shape. Window 7 may be counterpart trapezoid window of trapezoid fan 6. Trapezoid fan 6 of one pouch 61/62 can insert into counterpart trapezoid window 7 of another pouch 61'/62' to interlock each other in place.

Multiple trapezoid fans 6 and multiple counterpart trapezoid windows 7 are built and aligned at one line vertical to the opening 611/621 of a plastic pouch. Foot 4 of one pouch 61/62 can insert into the opening 611/621 of another pouch 61'/62' to allow its bottom trapezoid fan 6 to set in the second lowest trapezoid window 7 of the another pouch 61'/62', and optionally its second lowest trapezoid fan 6 to set in the third lowest trapezoid window 7 of the another pouch 61'/62' to interlock each other. The built-in multiple interlocking devices may be built at one side or both sides of each pouch 61/62. Building pieces 60 can thus be overlapped to build a variety of things, such as chicken, peacock and lobster, according to one's imagination and talent The flexible belt 63 can be bent or twisted at a degree of from −180° to +180° by human hands, preferably by a child's hands. In some embodiments, the containers/pouches 61/62 may be much more rigid than belt 63, for example, it may only be bent or twisted at a degree of from −5° to +5° by human hands. Therefore, the material of the flexible belt 63 may be different from the material of the wings 61/62. For example, the material of the containers/pouches (e.g. Acrylonitrile butadiene styrene, ABS) may have an elastic modulus that is at least 0.5, 1, 1.5, 2, 3, 4 or 5 times higher than that of the material (e.g. natural or synthetic rubber) of the flexible belt 63. The term "elastic modulus" is a quantity that measures an object or substance's resistance to being deformed elastically (i.e., non-permanently) when a stress such as a human hand force is applied to it. Alternatively, the containers/pouches 61/62 may have a thickness that is at least 2, 3, 4, or 5 times thicker than the thickness of the flexible belt 63, particularly when the containers/pouches and the belts are made of the same material for convenient manufacturability. Thickness optimization can make the belt 63 sufficiently flexible and the containers/pouches 61/62 sufficiently rigid.

When two or more building pieces 60, same or different, are used together as one set, the containers/pouches may be, or include, any suitable Lego piece, brick, block, gear, figurine, and minifigure etc. In other words, containers/pouches 61 and 62 can be built like any known Lego pieces. For example, two or more building pieces 60 can connect to each other to create a construction with a shape of human, animal, or plant such as lobster, butterfly, peacock and chicken.

It is contemplated that the flexible belt 63 can take the shape of any convex quadrilaterals, in which all interior angles are less than 180° and the two diagonals both lie inside the quadrilateral. For example, the belt 63's shape can be a trapezium, a trapezoid, an isosceles trapezoid, a parallelogram, a kite, a rhombus, a rectangle, an oblong, and a square. In preferred embodiments, the belt 63 has four peripheral edges. Two container/pouch 61/62 may extend from two opposite edges or "laterals" of the quadrilateral, the distance between which may be 100%, 80%, 60%, 40%, or 20% less than the distance between the other two opposite edges or "laterals". The distance between the other two opposite edges or "laterals" may be the same as the dimension of container/pouch 61/62 along the edge or "lateral" of the quadrilateral that it extends from. A user can connect together many pieces 60 as well any other compatible pieces to create a variety of interesting things according to his or her imagination and talent.

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A building piece comprising a first container comprising a first cavity with a first opening, a second container comprising a second cavity with a second opening, and a flexible belt connecting said two containers;

wherein the first container is tapered monotonously in all dimensions from the first opening to the rest of the first container's body, so that another container that is identical to the first container can insert its tapered body into the first cavity through the first opening;

wherein the second container is tapered monotonously in all dimensions from the second opening to the rest of the second container's body, so that another container that is identical to the second container can insert its tapered body into the second cavity through the second opening; wherein the first container further comprises one, two or more landscapes (or topographical profiles), so that, after another container that is identical to the first container inserts its tapered body into the first cavity through the first opening, a landscape of the first container can be reversibly interlocked into a landscape of said another container that is identical to the first container; and wherein each of said one, two or more landscapes includes a window through a cavity wall, and a protrusion sticking out from the window.

2. The building piece according to claim 1, wherein the first container and the second container are identical to each other.

3. The building piece according to claim 2, wherein the first container and the second container have a thickness that is at least 2 times thicker than the thickness of the flexible belt.

4. The building piece according to claim 1, wherein the second container further comprises one, two or more landscapes (or topographical profiles), so that, after another container that is identical to the second container inserts its tapered body into the second cavity through the second opening, a landscape of the second container can be reversibly interlocked to a landscape of said another container that is identical to the second container.

5. The building piece according to claim 4, wherein the first container and the second container are identical to each other.

6. The building piece according to claim 5, wherein the first opening and the second opening are proximal to the flexible belt, and the rest of the first container and the rest of the second container are tapered away distally from the flexible belt.

7. The building piece according to claim 6, wherein the first container and the second container are triangle-shaped, and wherein a side of the triangle shape is proximal to the flexible belt, and the rest of the first/second container is tapered away distally from the flexible belt to a vertex of the triangle shape.

8. A The building piece according to claim 7, which is butterfly-shaped with double plastic pouches equipped with interlocking device.

9. The building piece according to claim 7, wherein the protrusion is a trapezoid fan or a triangular fan.

10. The building piece according to claim 9, wherein the window is a trapezoid window.

11. The building piece according to claim 1, wherein the flexible belt is bent or twisted at a degree of from −180° to +180° by human hands.

12. The building piece according to claim 1, wherein the first container and the second container are rigid, and can only be bent or twisted at a degree of less than 5° by human hands.

13. The building piece according to claim 1, wherein the material of the flexible belt is different from the material of the first container and the second container.

14. The building piece according to claim 13, wherein the material of the first container and the second container (e.g. ABS) has an elastic modulus that is at least 2 times higher than that of the material of the flexible belt (e.g. rubber), wherein the term "elastic modulus" is a quantity that measures an object or substance's resistance to being deformed elastically (i.e., non-permanently) when a stress is applied to it such as by a human hand force.

15. The building piece according to claim 1, wherein the first container and the second container comprise a Lego piece, brick, block, gear, figurine, and minifigure.

16. The building piece according to claim 1, wherein the flexible belt has a shape selected from a trapezium, a trapezoid, an isosceles trapezoid, a parallelogram, a kite, a rhombus, a rectangle, an oblong, and a square.

17. The building piece according to claim 1, which can connect to other building pieces to create a construction with a shape of human, animal, or plant such as lobster, butterfly, peacock and chicken.

* * * * *